US006833171B2

(12) United States Patent
Campbell et al.

(10) Patent No.: US 6,833,171 B2
(45) Date of Patent: Dec. 21, 2004

(54) LOW TACK SLIP-RESISTANT SHOE COVER

(75) Inventors: Stephen M. Campbell, Winneconne, WI (US); Linda G. Harris, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/116,591

(22) Filed: Apr. 3, 2002

(65) Prior Publication Data

US 2003/0190442 A1 Oct. 9, 2003

(51) Int. Cl.[7] ..... A43B 3/16

(52) U.S. Cl. ..... 428/36.8; 36/4; 36/7.1 R; 36/7.3; 36/7.4; 36/7.6; 36/7.7; 36/59 R

(58) Field of Search ..... 428/36.8, 35.7; 36/4, 7.1 R, 7.3, 7.4, 7.6, 7.7, 59 R, DIG. 2

(56) References Cited

U.S. PATENT DOCUMENTS

| | | | | |
|---|---|---|---|---|
| 1,980,486 | A | 11/1934 | King et al. | 36/4 |
| 3,338,992 | A | 8/1967 | Kinney | 264/24 |
| 3,341,394 | A | 9/1967 | Kinney | 161/72 |
| 3,502,763 | A | 3/1970 | Hartmann | 264/210 |
| 3,542,615 | A | 11/1970 | Dobo et al. | 156/181 |
| 3,669,106 | A | 6/1972 | Schrading et al. | 128/132 D |
| 3,692,618 | A | 9/1972 | Dorschner et al. | 161/72 |
| 3,802,817 | A | 4/1974 | Matsuki et al. | 425/66 |
| 3,849,241 | A | 11/1974 | Butin et al. | 161/169 |
| 3,981,088 | A | 9/1976 | Mitchell et al. | 36/87 |
| 4,041,203 | A | 8/1977 | Brock et al. | 428/157 |
| 4,100,324 | A | 7/1978 | Anderson et al. | 428/288 |
| 4,338,227 | A | 7/1982 | Ballard | 524/143 |
| 4,340,563 | A | 7/1982 | Appel et al. | 264/518 |
| 4,374,888 | A | 2/1983 | Bornslaeger | 428/198 |
| 4,598,485 | A | 7/1986 | Joe et al. | 36/7.2 |
| 4,616,428 | A | 10/1986 | Leger | 36/7.1 R |

(List continued on next page.)

FOREIGN PATENT DOCUMENTS

| | | | | |
|---|---|---|---|---|
| EP | 0 234 615 | A1 | | 9/1987 |
| EP | 0 549 948 | A1 | | 7/1993 |
| EP | 0604917 | A2 | | 7/1994 |
| EP | 0 449 249 | B1 | | 6/1995 |
| EP | 0 713 546 | B1 | | 3/1997 |
| FR | 2 619 998 | | | 3/1989 |
| GB | 1148698 | | * | 4/1969 |
| GB | 2 124 472 | A | | 2/1984 |
| JP | 70032157 | B | * | 6/1967 |
| WO | WO91/04682 | | | 4/1991 |
| WO | WO91/09545 | | | 7/1991 |
| WO | WO94/14891 | | | 7/1994 |
| WO | WO94/19414 | | | 9/1994 |
| WO | WO94/21700 | | | 9/1994 |
| WO | WO97/38019 | | | 10/1997 |
| WO | WO99/15584 | | | 4/1999 |
| WO | WO99/22614 | | | 5/1999 |
| WO | WO01/57152 | A2 | | 8/2001 |

OTHER PUBLICATIONS

JP 8038204 A (abstract); Patent Assignee: AR Miki KK (ARMI–N); Feb. 13, 1996.

*Primary Examiner*—Sandra M. Nolan
(74) *Attorney, Agent, or Firm*—Vincent T. Kung; Scott B. Garrison; Dana E. Stano

(57) ABSTRACT

A shoe or foot covering with slip-resistant properties is disclosed. The shoe cover includes a slip-resistant material that is applied to the bottom portion of the shoe cover. The slip-resistant material may be a substantially amorphous atactic olefin polymer.

35 Claims, 2 Drawing Sheets

U.S. PATENT DOCUMENTS

| | | | | |
|---|---|---|---|---|
| 4,818,464 | A | 4/1989 | Lau | 264/510 |
| 4,897,935 | A | 2/1990 | Fel | 36/7.7 |
| 4,918,839 | A | 4/1990 | Brandon | 36/7.1 R |
| 5,062,223 | A | 11/1991 | Johnson | 36/7.1 R |
| 5,145,727 | A | 9/1992 | Potts et al. | 428/198 |
| 5,165,979 | A | 11/1992 | Watkins et al. | 428/113 |
| 5,169,706 | A | 12/1992 | Collier, IV et al. | 428/152 |
| 5,178,931 | A | 1/1993 | Perkins et al. | 428/198 |
| 5,188,885 | A | 2/1993 | Timmons et al. | 428/198 |
| 5,204,174 | A | 4/1993 | Daponte et al. | 428/286 |
| 5,213,881 | A | 5/1993 | Timmons et al. | 428/224 |
| 5,228,215 | A | 7/1993 | Bayer | 36/7.7 |
| 5,242,963 | A | 9/1993 | Mao | 524/272 |
| 5,596,052 | A | 1/1997 | Resconi et al. | |
| 5,597,194 | A | 1/1997 | Daugherty et al. | 296/39.2 |
| 5,597,647 | A | 1/1997 | Powers | 442/382 |
| 5,763,337 | A | 6/1998 | Montgomery | 442/398 |
| 5,776,295 | A | 7/1998 | Montgomery | 156/324 |
| 5,787,607 | A | 8/1998 | Schürch | 36/7.1 R |
| 5,822,884 | A | 10/1998 | Roeder | 36/7.1 R |
| 5,926,888 | A | 7/1999 | Chen et al. | |
| 5,983,526 | A | 11/1999 | Pawlik et al. | 36/7.1 R |
| 6,023,856 | A | 2/2000 | Brunson et al. | 36/7.1 R |
| 6,103,647 | A * | 8/2000 | Shultz et al. | 442/346 |
| 6,209,227 | B1 | 4/2001 | Swango et al. | 36/7.1 R |
| 6,298,855 | B1 | 10/2001 | Baird | 128/849 |

* cited by examiner

LOW TACK SLIP-RESISTANT SHOE COVER

BACKGROUND OF THE INVENTION

The present invention relates to protective garments, such as shoe covers, having slip-resistant properties. As is generally known, protective garments, such as surgical gowns, surgical drapes, and shoe covers (hereinafter collectively "surgical articles") have been designed to greatly reduce or prevent the transmission through the surgical article of liquid and/or airborne contaminants. In surgical environments, such liquid sources include the gown wearer's perspiration, patient liquids, such as blood, and life support liquids, such as plasma and saline. Examples of airborne contaminants include biological contaminants, such as bacteria, viruses, and fungal spores. Such contaminants may also include particulate material such as lint, mineral fines, dust, skin squamae, and respiratory droplets.

Many surgical articles were originally made from cotton or linen and were sterilized prior to use in the operating room. However, in many instances, surgical articles fashioned from cotton or linen provided insufficient barrier protection against airborne contaminants. Furthermore, these articles were costly, and of course, laundering and sterilization procedures were required before reuse.

Disposable surgical articles, which also may require sterilization prior to use, have largely replaced linen surgical articles. In some instances, such disposable surgical articles may be formed from nonwoven materials such as spunbond polypropylene or nonwoven laminates, such as spunbond/meltblown/spunbond laminates.

Some surgical articles, such as surgical gowns and drapes, are generally designed to loosely fit or overly the wearer. While surgical gowns and drapes are subjected to some pulling forces relative to the movement of the wearer, such gowns and drapes generally are not subjected to the load bearing forces or abrupt pulling or shearing forces to which more form-fitting surgical articles, such as shoe covers, may be subjected. As such, one challenge for designers of a fitted surgical articles is to sufficiently secure the seams in the fabric such that the article may withstand such load bearing, pulling, and shearing forces.

Additionally, in the case of shoe covers, it is not uncommon for the operating room floor or hospital floors, which are generally smooth by design, to become spotted with liquids that may be used or generated during a surgical procedure. As such, designers are further challenged to design a shoe cover that is both slip-resistant and cost effective. In the past, shoe covers were coated with a traction adhesive, such as a hot melt adhesive, to provide the shoe cover with slip-resistant properties. The traction adhesives were typically sprayed, coated, or printed on the shoe covers according to a particular pattern. Such adhesives have been found to be well-suited for use with shoe covers made from nonwoven polymeric laminates that by themselves provide limited traction. Unfortunately, since hot melt adhesives are somewhat tacky, the adhesives have a tendency to become coated with dust and other fine particulates over time. Once coated with such particles, the adhesives begin to lose much of their anti-slip characteristics. Further, hot melt adhesives also tend to contaminate the machines that are used to produce the shoe covers.

There is currently a need for a foot covering that has improved slip-resistant properties. More particularly, a need exists for a slip-resistant material for use on shoe covers that is less tacky than adhesives used in the past so that it will not collect dust and other particulates during use.

SUMMARY OF THE INVENTION

The present invention relates to a foot covering having a body shaped to surround a foot of a wearer, the body defining a bottom portion having an outside surface designed to contact the ground when the foot covering is being worn, and a slip-resistant material applied to the outside surface of the bottom portion, the slip-resistant material being an amorphous atactic olefin polymer. Any substantially amorphous atactic olefin polymer may be used, including polypropylene, polyethylene, or copolymers of propylene and ethylene. The polymer may have a broad molecular weight distribution, characterized by a polydispersity index of from about 4 to about 9. The polymer may be applied to the shoe cover according to various patterns.

The present invention also relates to a foot covering having a hollow body defining an opening for receiving a foot or a shoe, the hollow body being made from a nonwoven material, the body defining a bottom portion having an outside surface designed to contact the ground when the foot covering is being worn, and a slip-resistant material applied to the outside surface of the bottom portion. The slip-resistant material may be substantially amorphous atactic olefin polymer, including polypropylene, polyethylene, or copolymers of propylene and ethylene.

The present invention further relates to a foot covering having a body shaped to surround a foot of a wearer, the body defining a bottom portion having an outside surface designed to contact the ground when the foot covering is being worn, and a slip-resistant material applied to the outside surface of the body, the slip-resistant material being a copolymer of propylene and 1-butene. The present invention also contemplates use of terpolymers containing propylene, ethylene, and 1-butene. Additionally, any terminally unsaturated olefin such as 1-hexene or 1-octene may be copolymerized and used with the present invention.

The present invention includes a method of imparting slip-resistant properties to a foot covering including providing a foot covering having a body shaped to surround a foot of a wearer, the body defining a bottom portion having an outside surface designed to contact the ground when the foot covering is being worn, and applying a slip-resistant material to the outside surface of the body. The slip-resistant material may include a substantially amorphous atactic olefin polymer, for example, a copolymer of ethylene and propylene having from about 5% to about 15% percent ethylene by weight.

The present invention also includes a method of making a slip-resistant shoe cover including providing a body shaped to surround a foot of a wearer, the body defining a bottom portion having an outside surface designed to contact the ground when the shoe cover is being worn, and applying a slip-resistant material to the outside surface of the bottom portion. The slip-resistant material may include a copolymer of propylene and a terminally unsaturated olefin, for example 1-butene, 1-hexene, and 1-octene.

The present invention further includes a method of making a slip-resistant shoe cover including providing a body shaped to surround a shoe or a foot, the body defining a bottom portion having an outside surface designed to contact the ground when the shoe cover is being worn, and applying a slip-resistant material to the outside surface of the bottom portion. The slip-resistant material may include a substantially amorphous atactic olefin copolymer of ethylene and propylene, the polymer having a density of from about 0.8 grams per cubic centimeter to about 0.95 grams per cubic centimeter and having a polydispersity index of from about 4 to about 9.

DESCRIPTION OF THE INVENTION

Figure 1:
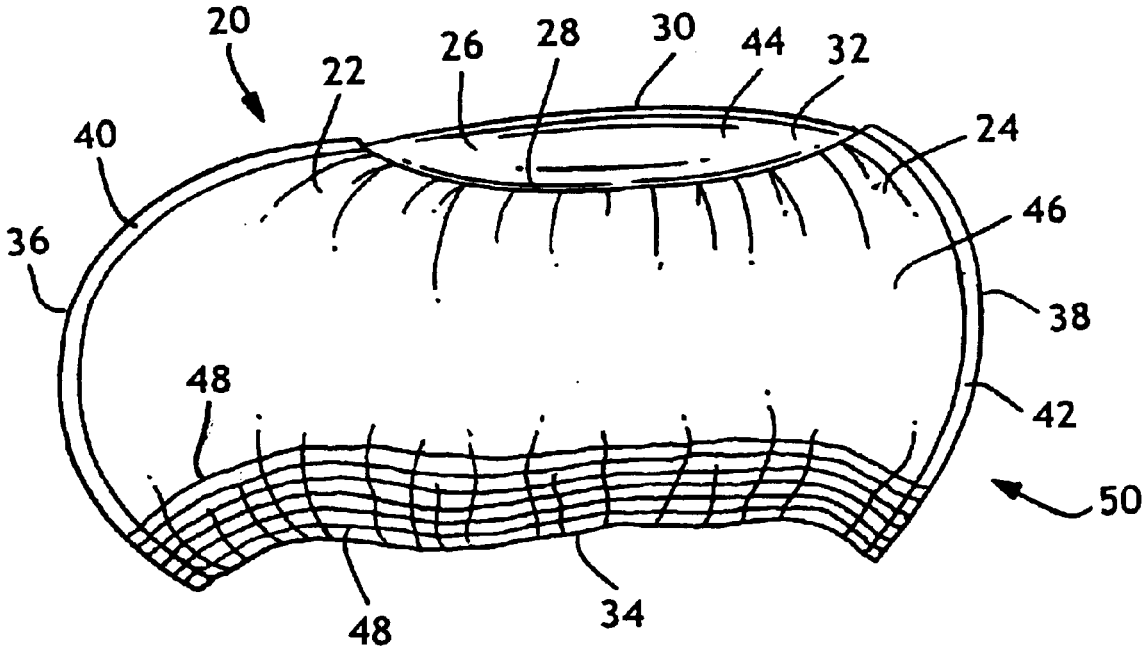
FIG. 1 is a side plan view of one embodiment of a shoe cover made in accordance with the present invention.

It is to be understood by one of ordinary skill in the art that the present discussion is a description of exemplary embodiments only, and is not intended to limit the broader aspects of the present invention.

The present invention is directed to a shoe cover having a bottom portion that has slip-resistant properties for providing traction to a wearer when worn on slippery surfaces. The shoe cover is made slip-resistant by applying a polymeric material to an outside surface of the bottom portion of the shoe cover. When compressed, the polymer conforms to an adjacent surface and provides the shoe cover with enhanced traction. Of particular advantage, the polymer of the present invention has a relatively high coefficient of friction without being as tacky and sticky as adhesives used in the past. Thus, the polymer is less likely to adhere to and become contaminated with dirt and other particulate material.

In general, the polymer used in accordance with the present invention may be described as a substantially amorphous atactic olefin polymer. By "substantially amorphous" it is meant that the polymer will become only 1–15% crystalline upon cooling. In some embodiments, low to moderate molecular weight polymers, such as polypropylene, polyethylene, or copolymers of propylene and ethylene may be used. It is contemplated that other low to moderate molecular weight olefin polymers may be used.

Substantially amorphous atactic olefin polymers may be readily processed and applied to various materials due to their broad molecular weight distribution and other physical characteristics. The molecular weight distribution of a polymer is often described by the polydispersity index, defined as the weight average molecular weight divided by the number average molecular weight. In some embodiments, the polydispersity index of the polymer may range from about 4 to about 9. The polymers may be substantially linear in geometry and may have a glass transition temperature, or Tg, of from about −15° C. to about −30° C. In some embodiments, the polymer may have a Tg from about −20° C. to about −29° C.

The polymers of the present invention may further be characterized as having a low density. In some embodiments, the solid density of the polymer may generally range from about 0.75 grams per cubic centimeter (g/cc) to about 0.95 g/cc. In other embodiments, the solid density of the polymer may range from about 0.82 g/cc to about 0.92 g/cc. In yet other embodiments, the solid density of the polymer may be about 0.86 g/cc.

Substantially amorphous atactic olefin polymers are well-suited for non-slip applications. They are soft and capable of spreading to increase surface area during use, thereby increasing traction. Softness is generally measured using the needle penetration test as provided by ASTM 1321. Suitable polymers may have a needle penetration of from about 12 dmm to about 30 dmm (1 dmm=0.1 mm). When the polymer is applied to the bottom portion of the shoe cover and pressed against a surface, such as a floor, the polymer tightly conforms to the topography of the floor. The increase in contact area significantly increases the coefficient of friction between the polymer and the surface.

The present invention contemplates use of various polymers. In some embodiments, a homopolymer of polypropylene may be used. The homopolymer may be atactic, i.e., having a low degree of crystallinity caused by a random monomer addition order. One such atactic polypropylene is available from Huntsman, Houston, Tex., under the trade name RT2115.

Alternatively, a copolymer may be used with the present invention. In one embodiment, the copolymer may be comprised of propylene and ethylene. The copolymer may comprise from about 5 percent to about 15 percent ethylene by weight. One such suitable copolymer is available from Huntsman, Houston, Tex., under the trade name RT2315. In other embodiments, copolymers of propylene and 1-butene may be used. In yet other embodiments, terpolymers containing propylene, ethylene, and 1-butene may be used. Alternatively, any other terminally unsaturated olefin such as 1-hexene or 1-octene may be copolymerized and used with the present invention.

Substantially amorphous olefin polymers process readily at temperatures below 300° F., and may therefore be applied using conventional adhesive application processes. Use of these polymers thus presents an advantage over high molecular weight polymers that cannot be processed using conventional techniques. The polymers may be heated above their softening point prior to application. Depending on the polymer selected for a given application, the processing temperature may be from about 250° F. to about 375° F. The polymers are self-adhering as applied, so no additional adhesive is needed to bond the polymer to the substrate.

The polymers of the present invention may be applied to a shoe cover either alone or in combination with other additives and ingredients. For instance, antioxidant stabilizers may be included. Colorants may also be added to the polymer for aesthetic appeal or for any other purpose. Likewise, antistatic agents may be incorporated into or applied to the shoe cover.

Figure 2:
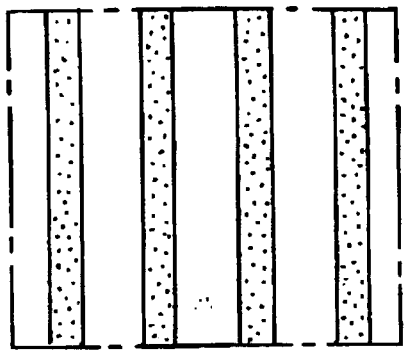
FIG. 2 depicts an exemplary stripe pattern that may be used with the present invention.
Figure 3:
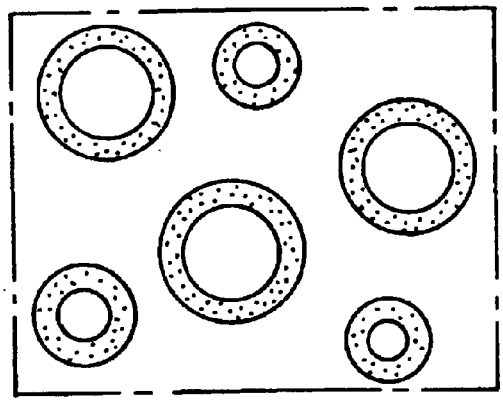
FIG. 3 depicts an exemplary circular ("calamari") pattern that may be used with the present invention.
Figure 4:
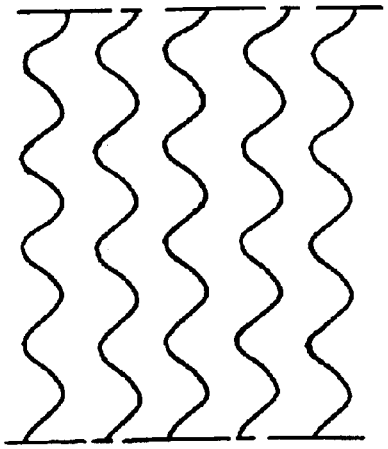
FIG. 4 depicts an exemplary wave pattern that may be used with the present invention.

In general, the polymer of the present invention may be applied to any suitable shoe or foot covering. The polymer may be applied according to various designs and patterns. The polymer may be applied as a continuous film or according to a repeating or nonrepeating pattern. The polymer may be applied in parallel stripes (FIG. 2), in a circular ("calamari") configuration (FIG. 3), according to an arbitrary design, or according to any pattern that will provide the shoe cover with sufficient traction. Alternatively, the polymer may be applied to the shoe cover in a wave pattern (e.g., squiggly lines) (FIG. 4).

The shoe cover to which the linear polymer or copolymer is applied according to the present invention may be formed from a variety of materials and fabrics, such as woven reusable fabrics and nonwoven disposable fabrics or webs. For instance, the shoe cover may be made from a woven or nonwoven polymeric fabric.

As used herein the term "nonwoven fabric or web" means a web having a structure of individual fibers or threads that are randomly interlaid, but not in an identifiable manner or pattern as in a knitted fabric. Nonwoven fabrics or webs have been formed from many processes, for example, melt-blowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91). Nonwoven materials suitable for use with the present invention include, for example, multilayer laminates such as a spunbond/meltblown/spunbond ("SMS") material. An example of a suitable fabric is disclosed in U.S. Pat. No. 4,041,203, which is hereby incorporated by reference.

As used herein the term "spunbond fibers" or "spunbonded fibers" refers to small diameter fibers that are formed by extruding molten thermoplastic material as filaments from a plurality of fine, usually circular capillaries of a spinneret with the diameter of the extruded filaments then being rapidly reduced, for example, as in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

As used herein the term "meltblown fibers" means fibers formed by extruding a molten thermoplastic material through a plurality of fine, usually circular, die capillaries as molten threads or filaments into converging high velocity, usually hot, gas (e.g. air) streams that attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al. Meltblown fibers may be continuous or discontinuous, are generally smaller than 10 microns in average diameter, and are generally tacky when deposited onto a collecting surface.

As used herein "multilayer laminate" means a laminate wherein some of the layers are spunbond or some meltblown such as a spunbond/meltblown/spunbond (SMS) laminate and others as disclosed in U.S. Pat. No. 4,041,203 to Brock et al., U.S. Pat. No. 5,169,706 to Collier, et al., U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy (25 to 100 gsm). Multilayer laminates may also have various numbers of meltblown layers or multiple spunbond layers in many different configurations and may include other materials like films or coform materials, e.g. SMMS, SM, SFS, etc.

As used herein, the term "coform" means a process in which at least one meltblown diehead is arranged near a chute through which other materials are added to the web while it is forming. Such other materials may be pulp, superabsorbent particles, cellulose or staple fibers, for example. Coform processes are shown in commonly assigned U.S. Pat. No. 4,818,464 to Lau and U.S. Pat. No. 4,100,324 to Anderson et al. Webs produced by the coform process are generally referred to as "coform materials".

Nonwoven polymeric fabrics that may be used in the present invention may be formed from a single layer or multiple layers. In the case of multiple layers, the layers are generally positioned in a juxtaposed or surface-to-surface relationship and all or a portion of the layers may be bound to adjacent layers.

Polymeric fabrics are particularly suitable for use in the construction of shoe covers that are designed to be worn in hospitals and other similar environments. Such polymeric fabrics, in particular nonwoven polymeric fabrics, may be made according to a variety of processes including, but not limited to, air laid processes, wet laid processes, hydroentangling processes, spunbonding, meltblowing, staple fiber carding and bonding, and solution spinning. The fibers themselves may be made from a variety of dielectric materials including, but not limited to, polyesters, polyolefins, nylons and copolymers of these materials. The fibers may be relatively short, staple length fibers, typically less than 3 inches, or longer more continuous fibers such as are typically produced by a spunbonding process.

Commercially available nonwoven polymeric fabrics that may be used to construct the shoe covers of the present invention include the polypropylene nonwoven fabrics produced by the Assignee of record, Kimberly-Clark Worldwide, Inc. For instance, in one embodiment, the nonwoven fabric may be a laminate including at least one ply formed from spunbond fibers and another ply formed from meltblown fibers, such as a spunbond/meltblown (SM) nonwoven laminate. In another embodiment, the nonwoven laminate may include at least one ply formed from meltblown fibers that is positioned between two plies formed from spunbond fibers, such as a spunbond/meltblown/spunbond (SMS) nonwoven laminate. Such SMS nonwoven laminates usually have a basis weight of from about 0.1 to 12 ounces per square yard (osy) (3 to 400 grams per square meter (gsm)), or more desirably from about 0.75 to about 3 osy (25 to 100 gsm). Examples of these nonwoven laminates are disclosed in U.S. Pat. No. 4,041,203 to Brock, et al., U.S. Pat. No. 5,169,706 to Collier, et al., and U.S. Pat. No. 4,374,888 to Bornslaeqer, which are all herein incorporated by reference. It should be noted, however, that materials other than nonwovens may be used. Examples of such other materials include wovens, films, foam/film laminates and combinations thereof, for example, a spunbond/film/spunbond (SFS) laminate.

The spunbond fibers may be formed from a polyolefin, for example, polypropylene. One suitable polypropylene is commercially available as PD9355 from the Exxon Chemical Company of Baytown, Tex. The meltblown fibers may be formed from a polyolefin, such as polypropylene and polybutylene or a blend thereof. Examples of such meltblown fibers are contained in U.S. Pat. Nos. 5,165,979 and 5,204,174, both incorporated herein by reference. Desirably, the meltblown fibers may be formed from a blend of polypropylene and polybutylene. In some embodiments, the polybutylene is present in the blend in a range of from about 0.5 percent to about 20 percent by weight. One such suitable polypropylene is designated 3746-G from the Exxon Chemical Company of Baytown, Tex. One such suitable polybutylene is available as DP-8911 from the Shell Chemical Company of Houston, Tex. The meltblown fibers may also contain a polypropylene modified according to U.S. Pat. No. 5,213,881, incorporated herein by reference.

If desired, once the polymer is applied to the fabric, the fabric may then be contacted with a roll, such as a nip roll, for further securing the polymer to the fabric. For instance, a nip roll at a pressure of about 60 psi may be placed in contact with the fabric. In this manner, the polymer is forced into the interstices of the fabric for creating a stronger bond between the two materials. Alternatively, the polymer may be applied to the fabric by any other suitable means known in the art.

Referring now to FIG. 1, one embodiment of a shoe cover made in accordance with the present invention is illustrated. The shoe cover illustrated in FIG. 1 is particularly well adapted for use in hospitals and other similar environments and may be made, for instance, from a nonwoven material. It should be understood, however, that the shoe cover illustrated in the figure merely represents one embodiment of the present invention. The slip-resistant polymer of the present invention may be used with other types of shoe and foot coverings.

Referring to FIG. 1, an exemplary shoe cover 20 is illustrated. The shoe cover 20 includes a body 22 formed by a pair of panels 24 and 26. The panels 24 and 26 include a top edge 28 and 30, respectively. The top edges 28 and 30 define an opening 32 for receiving a sole (not shown) of a foot or a shoe (not shown). The panels 24 and 26 are joined along a common bottom edge 34 and side edges 36 and 38 forming seams 40 and 42, respectively, and bottom portion 50. Each panel 24 and 26 includes an inside surface 44 and an outside surface 46.

The top edges 28 and 30 include a strip of elastic material (not shown). The opening 32 is expandable to be form fitting about the wearer's ankle (not shown). The bottom edge 34 is also made expandable by being secured to another strip of elastic material (not shown). The shoe cover 20 fits snugly about the toe and heel portions of the sole (not shown).

In accordance with the present invention, the shoe cover 20 further includes a plurality of slip-resistant materials or stripes 48 located on the bottom portion 50 near the bottom edge 34. As described above, stripes 48 according to the present invention are formed from any substantially amorphous atactic olefin polymer, for example, polypropylene, polyethylene, and copolymers of propylene and ethylene. As shown in FIG. 1, in this embodiment, stripes 48 are oriented along the length of the bottom portion 50 of the shoe cover. It should be understood, however, that any suitable pattern may be applied to the shoe cover 20. Other possible patterns are exemplified in FIGS. 2–4.

Similarly, so that sufficient traction may be formed between the inside surface 44 of the shoe cover 20 and the sole (not shown) of either the wearer's foot or shoe (not shown), a traction pattern may also be applied to the inside surface 44 of panels 24 and/or 26 near the bottom edge 34. The traction pattern (not shown) applied to the inside surface 32 may be similar to the traction pattern applied to the outside surface 46 of the bottom portion 50.

The invention may be embodied in other specific forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A foot covering comprising:

a body shaped to surround a foot of a wearer, the body defining a bottom portion having an outside surface designed to contact the ground when the foot covering is being worn; and a slip-resistant material applied to the outside surface of the body, the slip-resistant material comprising a substantially amorphous, atactic olefin polymer.

2. The foot covering of claim 1, wherein the polymer comprises polypropylene.

3. The foot covering of claim 1, wherein the polymer has a glass transition temperature (Tg) of between about −15° C. and about −30° C.

4. The foot covering of claim 1, wherein the polymer comprises a copolymer of ethylene and propylene.

5. The foot covering of claim 4, wherein the copolymer comprises from about 5 percent to about 15 percent ethylene by weight.

6. The foot covering of claim 1, wherein the polymer has a polydispersity index of from about 4 to about 9.

7. The foot covering of claim 1, wherein the polymer has a density of from about 0.8 grams per cubic centimeter to about 0.95 grams per cubic centimeter.

8. The foot covering of claim 1, wherein the polymer has a density of from about 0.82 grams per cubic centimeter to about 0.92 grams per cubic centimeter.

9. The foot covering of claim 1, wherein the polymer adheres to the body of the foot covering.

10. The foot covering of claim 1, wherein the polymer is applied to the body according to a repeating pattern.

11. A shoes cover comprising:

a hollow body defining an opening for receiving a foot or a shoe, the hollow body being made from a nonwoven material, the body defining a bottom portion having an outside surface designed to contact the ground when the shoe cover is being worn; and a slip-resistant material applied to the outside surface of the bottom portion, the slip-resistant material comprising a substantially amorphous, atactic olefin polymer, with a glass transition temperature (Tg) of between about −15° C. and about −30° C.

12. The shoe cover of claim 11, wherein the polymer comprises polypropylene.

13. The shoe cover of claim 12, wherein the polymer is substantially linear.

14. The shoe cover of claim 12, wherein the polymer comprises a copolymer of propylene and ethylene.

15. The shoe covet of claim 11, wherein the polymer has a density of from about 0.8 grams per cubic centimeter about 0.95 grams per cubic centimeter.

16. The shoe cover of claim 15, wherein the polymer has a polydispersity index of from about 4 to about 9.

17. The cover of claim 11, wherein the polymer adheres to the nonwoven material.

18. The shoe cover of claim 12, wherein the nonwoven material comprises a laminate.

19. A The shoe cover of claim 18, wherein the laminate comprises a meltblown nonwoven web placed between a first spunbond nonwoven web and a second spunbond nonwoven web.

20. A foot covering comprising:

a body shaped to surround a foot of a wearer, the body defining a bottom portion having an outside surface designed to contact the ground when the foot covering is being worn; and a slip-resistant material applied to the outside surface of the bottom portion, the slip-resistant material comprising a substantially amorphous, atactic olefin polymer, the polymer having a density of from about 0.75 grams per cubic centimeter to about 0.95 grams per cubic centimeter and having a polydispersity index of from about 4 to about 9.

21. The foot covering of claim 20, wherein the polymer is substantially linear and has a glass transit on temperature (Tg) of between about −15° C. and about −30° C.

22. The foot covering of claim 21, wherein the polymer comprises a copolymer of ethylene and propylene.

23. The foot covering of claim 22, wherein the copolymer comprises from about 5 percent to about 15 percent ethylene by weight.

24. The foot covering of claim 20, wherein the slip-resistant material is applied as a plurality of stripes.

25. The foot covering of claim 23, wherein the body of the foot covering is made from a nonwoven material.

26. A foot covering comprising:

a body shaped to surround a foot of a wearer, the body defining a bottom portion having an outside surface designed to contact the ground when the foot covering is being worn; and a slip-resistant material applied to the outside surface of the bottom portion, the slip-resistant material, with a glass transition temperature (Tg) of between about −15° C. and about −30° C., and comprising an amorphous atatic copolymer of propylene and a terminally unsaturated olefin.

27.The foot covering of claim 26, wherein the terminally unsaturated olefin comprises 1-butene.

28.The foot covering of claim 26, wherein the terminally unsaturated olefin comprises 1-hexene.

29. The foot covering of claim 26, wherein the terminally unsaturated olefin comprises 1-octene.

30. A foot covering comprising:

a body shaped to surround a foot of a wearer, the body defining a bottom portion having an outside surface designed to contact the ground when the foot covering is being worn; and a slip-resistant material applied to the outside surface of the bottom portion, the slip-resistant material comprising an amorphous atatic terpolymer of propylene, ethylene, and 1-butene.

31. A method of imparting slip-resistant properties to a foot covering, comprising:

providing a foot covering having a body shaped to surround a foot of a wearer, the body defining a bottom portion having an outside surface designed to contact the ground when the foot covering is being worn; and applying a slip-resistant material to the outside surface of the body, the slip-resistant material comprising a substantially amorphous atactic olefin polymer.

32. The method of claim 31, wherein the polymer comprises a copolymer of ethylene and propylene having from about 1% to about 15% percent ethylene by weight.

33. A method of making a slip-resistant shoe cover, comprising:

providing a body shaped to surround a foot of a wearer, the body defining a bottom portion having an outside surface designed to contact the ground when the shoe cover is being worn; and applying a slip-resistant material to the outside surface of the bottom portion, the slip-resistant material comprising an amorphous atatic copolymer of propylene and a terminally unsaturated olefin.

34. The method of claim 33, wherein the terminally unsaturated olefin is selected from the group consisting of 1-butene, 1-hexene, and 1-octene.

35. A method of making a slip-resistant shoe cover, comprising:

providing a body shaped to surround a shoe or a foot, the body defining a bottom portion having an outside surface designed to contact the ground when the shoe cover is being worn; and applying a slip-resistant material to the outside surface of the bottom portion, the slip-resistant material comprising a substantially amorphous atactic olefin copolymer of ethylene and propylene, the polymer having a density of from about 0.75 grams per cubic centimeter to about 0.95 grams per cubic centimeter and having a polydispersity index of from about 4 to about 9.

* * * * *